US005815773A

United States Patent [19]

Zaman

[11] Patent Number: 5,815,773

[45] Date of Patent: Sep. 29, 1998

[54] COMPOSITE PHOTORECEPTOR FLANGE

[75] Inventor: Kamran U. Zaman, Pittsford, N.Y.

[73] Assignee: Xerox Corporation, Stamford, Conn.

[21] Appl. No.: 883,990

[22] Filed: Jun. 27, 1997

[51] Int. Cl.[6] ..... G03G 15/00

[52] U.S. Cl. ..... 399/117; 399/167; 492/47

[58] Field of Search ..... 399/117, 159, 399/167; 492/47

[56] References Cited

U.S. PATENT DOCUMENTS

| | | | |
|---|---|---|---|
| 4,120,576 | 10/1978 | Babish | 399/116 |
| 4,162,032 | 7/1979 | Lockwood | 226/81 |
| 4,400,077 | 8/1983 | Kozuka et al. | 399/117 |
| 4,561,763 | 12/1985 | Basch | 399/116 |
| 4,914,478 | 4/1990 | Yashiki | 399/117 |
| 5,164,777 | 11/1992 | Agarwal et al. | 399/165 |
| 5,357,321 | 10/1994 | Stenzel et al. | 399/167 |
| 5,457,520 | 10/1995 | Schell et al. | 399/117 |
| 5,461,464 | 10/1995 | Swain | 399/159 |
| 5,599,265 | 2/1997 | Foltz | 492/47 |
| 5,630,196 | 5/1997 | Swain | 399/117 |

*Primary Examiner*—William J. Royer

[57] ABSTRACT

An end flange capable of translating a rotational force from an outside source to a hollow cylindrical member is disclosed. The end flange is made from a composition which includes polycarbonate, polytetrafluorethylene, and glass. The end flange may be used to rotate an electrophotographic imaging member past a charging station, for generation of a uniform electrical potential thereon, and subsequent selective discharging of the imaging member and development of an electrostatic latent image. Most notably, mounting of the end flange to the imaging member does not require the use of an adhesive material. This enables successful recycling of the imaging member, and results in significant cost savings.

15 Claims, 4 Drawing Sheets

COMPOSITE PHOTORECEPTOR FLANGE

This invention relates in general to an apparatus for supporting hollow cylindrical support members and more specifically to an end flange for supporting hollow cylindrical support members without the use of an adhesive.

BACKGROUND OF THE INVENTION

The xerographic imaging process begins by charging a photoconductive member to a uniform potential, and then exposing a light image of an original document onto the surface of the photoreceptor, either directly or via a digital image driven laser. Exposing the charged photoreceptor to light selectively discharges areas of the surface while allowing other areas to remain unchanged, thereby creating an electrostatic latent image of the document on the surface of the photoconductive member. A developer material is then brought into contact with the surface of the photoreceptor to transform the latent image into a visible reproduction. The developer typically includes toner particles with an electrical polarity opposite that of the photoconductive member. A blank copy sheet is brought into contact with the photoreceptor and the toner particles are transferred thereto by electrostatic charging the sheet. The sheet is subsequently heated, thereby permanently affixing the reproduced image to the sheet. This results in a "hard copy" reproduction of the document or image. The photoconductive member is then cleaned to remove any charge and/or residual developing material from its surface to prepare it for subsequent imaging cycles.

Electrophotographic imaging members are well known in the art. One type of photoreceptor conventionally utilized for copiers and printers comprises a hollow electrically conductive drum substrate which has been dip coated with various coatings including at least one photoconductive coating comprising pigment particles dispersed in a film-forming binder. These photoreceptors are usually supported on an electrically conductive shaft by drum supporting hubs or end flanges. The hubs are usually constructed of plastic material and have a hole through their center into which a supporting axle shaft is inserted. Since hubs are usually constructed of electrically insulating plastic material, an electrical grounding means comprising a flexible spring steel metal strip is secured to the hub and positioned to contact both the electrically conductive axle shaft and the electrically conductive metal substrate of the photoreceptor drum. One type of grounding means is illustrated in U.S. Pat. No. 4,561,763 to Basch issued Dec. 31, 1985, the contents of which are hereby incorporated by reference. A drum supporting hub is disclosed having a tapered pot-like hub configuration comprising a bottom section and a rim, the rim comprising a plurality of circumferentially spaced resilient fingers extending at a slight incline outwardly from the axis of the pot-like hub away from the bottom section, at least three of the fingers having lips at the ends of the fingers, the lips projecting away from the axis for engagement with an end of a cylindrical drum upon insertion of the pot-like hub into the drum, the rim other than the lips having an outside diameter slightly larger than the outside diameter of the bottom. The drum supporting hub is employed in a drum assembly comprising the hub, a cylindrical drum having a circular cross-section and a shaft positioned along the axis of the drum. A metal shim is utilized to electrically ground the drum to the shaft.

Unfortunately, this metal ground shim is often bent out of alignment when inserted into one end of a photoreceptor drum. Such misalignment can result in the metal strip not contacting the interior of the drum or the axle or both after insertion of the hub into the end of the drum is completed. Further, coatings electrically insulating in the dark that are formed on the surface of the interior of the drum during dip coating can adversely affect electrical grounding of the drum to the electrically conductive drum axle shaft. If inadequate electrical grounding of the drum to the axle shaft is detected after the drum has been inserted into a modular replacement unit in which photoreceptor and various other subsystems such as cleaning and charging units are permanently mounted, repair of the drum is usually impossible without destruction of the module.

Photoreceptors presently available in the art are often secured to the hub or end flange with a thermosetting resin adhesive. An example of this type of device is disclosed in U.S. Pat. No. 4,914,478 to Yashiki issued Apr. 03, 1990, the contents of which are hereby incorporated by reference. However, recycling of used drums having glued hubs is difficult, if not impossible, because of damage to the hub or the drum or both during removal of the hub from the drum by common techniques such as by hammering. Such removal techniques damage or destroy both the drum and the hub. Further, where disassembly is accomplished without damage, cleaning of both the hub and the cylindrical substrate is required to remove adhering adhesive. In addition, adhesive application equipment utilized during mounting of an end flange to a cylindrical substrate are difficult to maintain because the adhesive has a short pot life and often solidifies and clogs the equipment thereby requiring time consuming efforts to clean and remove the solidified adhesive. The use of bolts and nuts to secure hubs to drums requires time intensive activity and does not address the problem of electrically grounding a drum substrate to the drum axle shaft.

One existing end flange device which avoids the use of adhesive materials is U.S. Pat. No. 5,357,321 to Stenzel et al. issued Oct. 18, 1994, which utilizes resilient fingers having pointed tips that dig into and penetrate the inner surface of the drum. A drum supporting hub is disclosed comprising a disk shaped member having a circular periphery, a hole extending axially through the center of the disk shaped member, and at least one long thin electrically conductive resilient member secured to the disk shaped member, the resilient member having a central section adjacent the hole and having opposite ends, each of the ends terminating into at least one pointed tip adjacent the circular periphery of the disk shaped member, and the resilient member having a major plane substantially parallel to the axis of the disk shaped member. This hub may be inserted in at least one end of a cylindrical electrostatographic imaging member to produce an imaging member assembly. While this hub may adequately support the photoreceptor, the pointed tips can form scratches and grooves in the interior surface of the drum during installation, use and removal. These scratches or grooves can adversely affect recycling of the cylindrical substrate.

Another glueless arrangement is disclosed in U.S. Pat. No. 5,461,464 to Swain issued Oct. 24, 1995, which discloses a photoreceptor assembly including a substrate coated with a photoconductive material, and with flange members engaged with the end sections of the substrate. The flange member engaged with the first end section is comprised of a projection which fits into the surface hole of the first end section. The flange member at the second end includes a projection which fits into a surface hole that resides in the second end section. There is no adhesive present between the engaging surfaces of the substrate and the flange members.

The following disclosures may be relevant to various aspects of the present invention:

U.S. Pat. No. 5,630,196 to Swain issued May 13, 1997, discloses a hollow cylinder supporting end flange including a disk shaped member having a circular periphery and a coil spring having a major plane substantially parallel to the major plane of the disk shaped member. The coil spring also has an exposed arcuate outer periphery with a diameter larger than the inside diameter of the hollow cylinder, an outer exposed end and an inner end, with the inner end comprising a section secured to the end flange and the exposed arcuate outer periphery of the coil spring being adjacent the circular periphery of the disk shaped member for engagement with a hollow cylindrical member upon insertion of the coil spring into the hollow cylindrical member. The end flange may be utilized as a component of an assembly including a hollow cylindrical electrostatographic imaging member having a circular cross section and an inner surface, and an end flange secured to at least one end of the hollow cylindrical member by a partially wound coil spring, the spring having an inner end and an outer end, the inner end being secured to the end flange and the outer end having an exposed arcuate outer surface in frictional contact with the inner surface of the hollow cylindrical member. A process for fabricating this assembly is also disclosed.

U.S. Pat. No. 5,599,265 to Foltz issued Feb. 4, 1997 discloses a hollow cylinder supporting end flange comprising a disk shaped member, a supporting hub extending axially from the disk shaped member and an annular ring supported on the hub, the ring comprising a plurality of sharp protrusions or barbs extending from the ring in a direction away from the hub for engagement with the hollow cylindrical member upon insertion of the annular ring into the hollow cylindrical member. This end flange is utilized in an assembly comprising a hollow cylindrical member having a circular cross section and an inner surface and an end flange comprising a disk shaped member having a circular periphery, a supporting hub extending axially from the disk shaped member into one end of the hollow cylindrical member and an annular ring supported on and secured to the hub, the ring comprising a plurality of sharp protrusions extending from the ring in a direction away from the hub into engagement with inner surface of the hollow cylindrical member to secure the hollow cylindrical member to the end flange.

U.S. Pat. No. 4,400,077 to Kozuka et al. issued August 1983 discloses a photosensitive drum assembly for an electrostatic copying apparatus which includes a cylindrical drum with a photosensitive layer around its outer periphery. The drum is held between a pair of flanges at opposite axial ends of the drum. Each of the flanges is formed having a diameter larger than the external diameter of the drum. At the edge of each flange is a cylindrical portion extending along the axis of the drum to face toward the opposite flange. The end edges of the drum closely fit into the cylindrical portions.

U.S. Pat. No. 4,120,576 to Babish issued Oct. 17, 1978 discloses a drum support apparatus including outboard and inboard hubs having outer surfaces and adapted for interface fitting with the inside surface of the drum. The hubs are supported on a shaft that is cantilevered from a frame and have recessed areas on central portions to cooperate with locking tabs located on a tubular member loosely fitted on the shaft.

All of the references cited herein are incorporated by reference for their teachings.

Accordingly, although known apparatus and processes are suitable for their intended purposes, a need remains for an apparatus which is capable of supporting hollow cylindrical support members without the use of an adhesive, to facilitate recycling.

SUMMARY OF THE INVENTION

In accordance with the present invention, there is provided an end flange capable of translating a rotational force from an outside source to a hollow cylindrical member, which includes: a circular member made from a composition including polycarbonate, polytetrafluorethylene, and glass; and an electrically conductive material attached to the circular member which provides a ground contact for the hollow cylindrical member.

In accordance with another aspect of the invention, there is provided an electrophotographic imaging system, including: a source capable of generating a rotational force; an end flange communicating with said source such that said rotational force is translated to said end flange, said end flange being made from a composite material including polycarbonate, polytetrafluorethylene, and glass; a circular photoreceptor mounted to said end flange, thereby causing rotation of said end flange; and an electrically conductive substance mounted between said photoreceptor and said end flange to provide a grounding contact for said photoreceptor.

The present invention has significant advantages over current methods and apparatus for supporting hollow cylindrical support members without using an adhesive. First, it quickly achieves excellent anchoring of the end flange to a hollow cylindrical member, while also facilitating recycling of end flange and hollow cylindrical member. The present invention also maintains excellent electrical grounding of an electrostatographic substrate.

BRIEF DESCRIPTION OF THE DRAWINGS(D/94784)

Other features and advantages of the present invention will become apparent as the following description proceeds and upon reference to the drawings, in which.

Figure 4A:
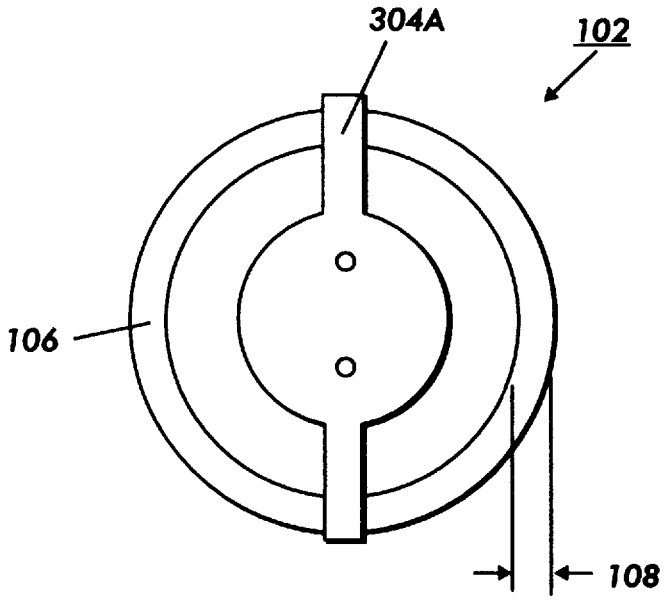
Figure 4B:
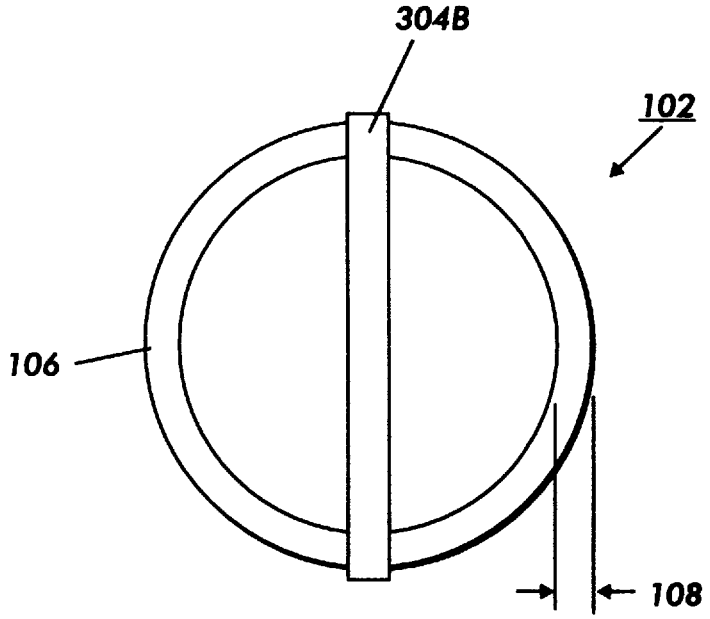

FIGS. 4A and 4B contain examples of two devices that may be used to provide grounding for the photoreceptor by the composite flange of the present invention.

Figure 5:
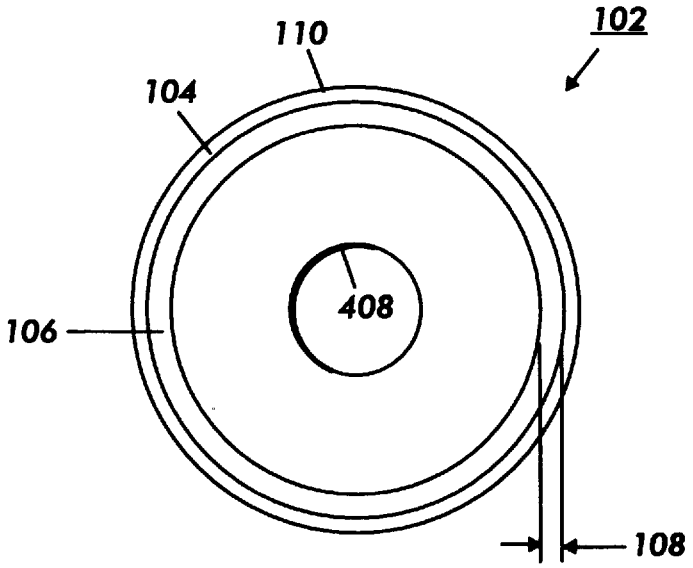

FIG. 5 contains a front view of a composite flange of the present invention with an inner diameter in the grounding plate.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE PREFERRED EMBODIMENT

While the present invention may be employed in any suitable device that requires support for a drum, it will be described herein with reference to an more specifically to an end flange for supporting hollow cylindrical support members in an electrostatographic imaging system without the use of an adhesive.

Figure 1:
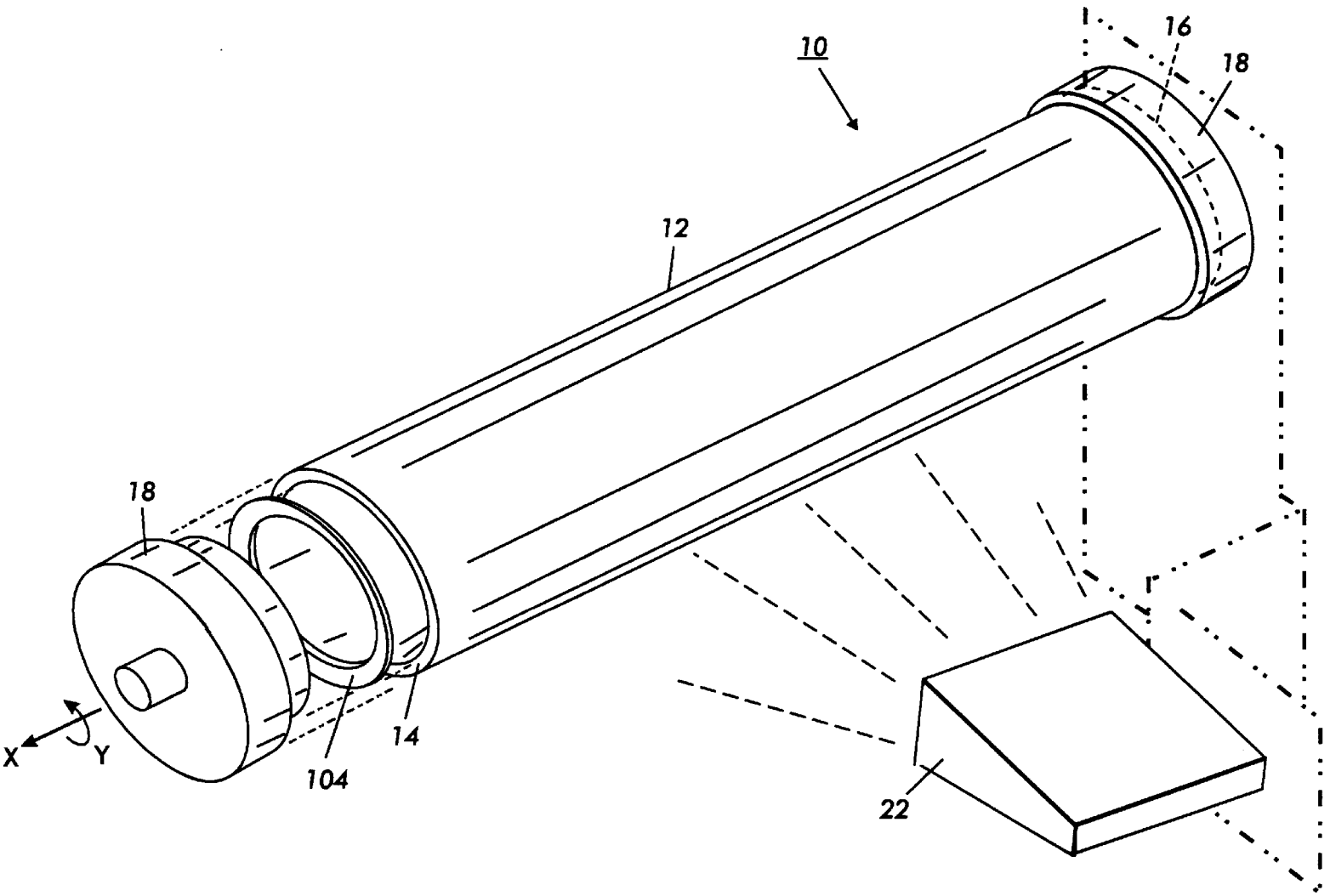
FIG. 1 depicts a schematic, three dimensional view of the composite photoreceptor flange of the present invention as it is mounted to an electrophotographic photoreceptor.

Referring now to the drawings where the showings are for the purpose of describing an embodiment of the invention and not for limiting same, FIG. 1 depicts a schematic, three dimensional view of the composite photoreceptor flange of the present invention, mounted to an electrophotographic photoreceptor. At least one gear 18 or similar device is mounted to an outside source such as a motor 20 (not shown) to cause rotation of gear 18 about axis x as indicated by arrow y. Gear 18 is attached to one or both ends 14 and 16 of photoreceptor 12, causing photoreceptor 12 to rotate past corona device 22 for charging of the photoreceptor to a uniform electrostatic potential. A light image of an original document is exposed onto the surface of photoreceptor 12 to selectively discharge areas of the surface which correspond to blank areas in the original image. A developer material is then brought into contact with the surface of the photoreceptor to transform the latent image into a visible reproduction.

Figure 2A:
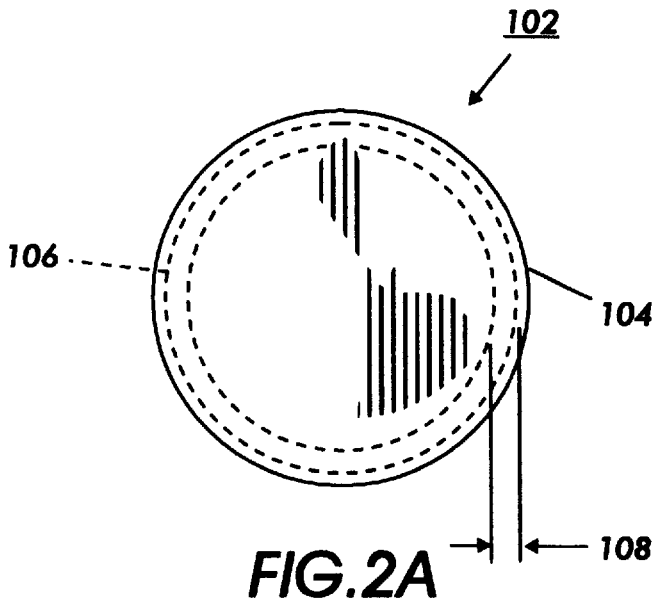
FIG. 2A depicts a front view of the composite photoreceptor flange of the present invention.
Figure 2B:
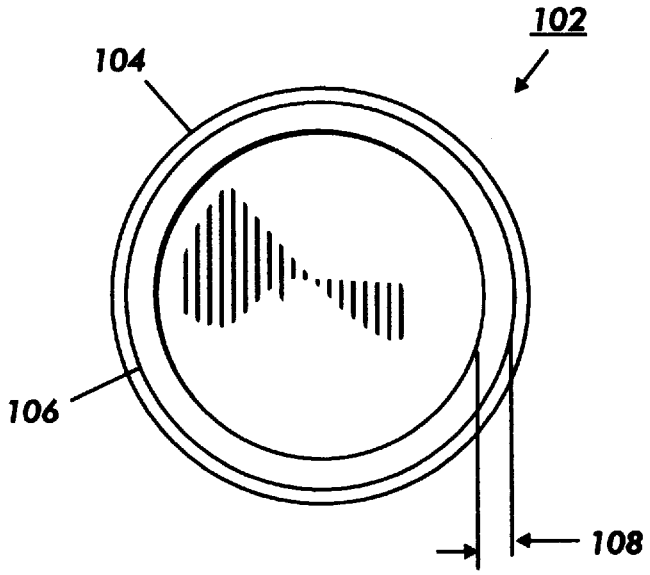
FIG. 2B depicts a rear view of the composite photoreceptor flange of the present invention.

FIGS. 2A and 2B depict front and rear views of composite photoreceptor flange 102 of the present invention. As shown, flange 102 has an outer diameter 106, and a thickness 108.

Figure 3:
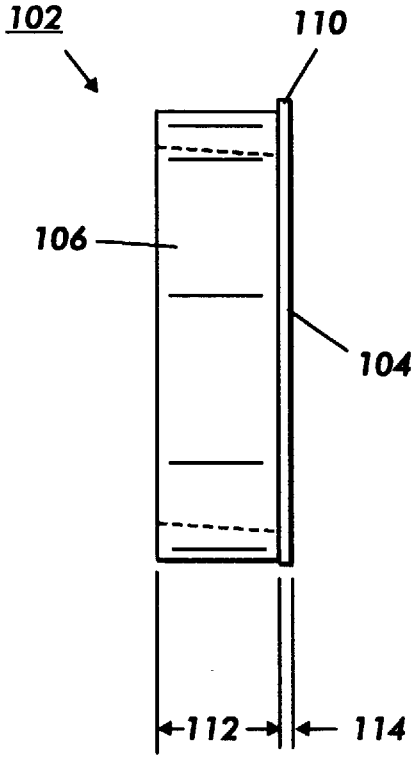
FIG. 3 depicts a side view of the composite photoreceptor flange of the present invention.

Referring now to FIG. 3 flange 102 has a length 112, to assist in providing torsional and axial support for photoreceptor 12. As indicated above, photoreceptor 12 rotates about axis x, due to the rotation of gear 18. Flange 102 serves to transfer the torsional force applied by source 20 from gear 18 to photoreceptor 12. While flange 102 provides axial as well as torsional support, the primary loads applied to it result from the torque from motor 20. Photoreceptor 12 must often operate under torsional loads of as much as 45 lbs-in. Thus, flange 102 must be able to withstand loads of this magnitude in order to successfully transfer the required torque from motor 20 to photoreceptor 12. The magnitudes of length 112, and outer diameter 106 must both be considered when flange 102 is being designed. If design constraints unrelated to rotation of photoreceptor 12 (such as the configuration of the cavity of the machine) place limitations on either or both of these dimensions, length 112 can be changed as long as outer diameter 106 is altered accordingly. For example, a longer photoreceptor 12 with a relatively small diameter can be supported with flange 102 as long as the decrease in outer diameter 106 is accompanied by a proportional increase in length 112. Similarly, a machine that requires the use of a relatively short photoreceptor 12 can be supported by flange 102 as long as outer diameter 106 can be increased along with any required decrease in length 112.

A ground contact for photoreceptor 12, such as plate 104 shown in FIGS. 2A and 2B is provided with flange 102. In the example shown in FIGS. 2A and 2B, plate 104 has an outer diameter 110 which extends beyond the outer diameter 106 of flange 102. Those skilled in the art will recognize that there are numerous ways to ground photoreceptor 12, including the use of devices similar to those depicted in FIGS. 4A and 4B indicated by reference numerals 304A and 304B respectively.

Plate 104 is made from an electrically conductive material that will prevent corrosion of the photoreceptor. The materials from which electrophotographic photoreceptors are made are typically chosen from a small group of materials that are known to satisfy imaging requirements. While aluminum is the most popular material presently being used, the materials from which photoreceptors are made may include magnesium, zinc, aluminum, cadmium, steel, lead, tin and nickel. Certain materials are commonly known to cause corrosion when they are brought in contact with the materials listed above. Thus, it is imperative to choose a material for ground plate 104 that will prevent corrosion in the contacting photoreceptor. More accurately stated, the material from which photoreceptor 12 is made should be known to corrode before the material chosen for ground plate 104. Brass, bronze, copper, nickel-copper alloy, stainless steel, silver, gold and platinum have all proven to be suitable materials for ground plate 104 when photoreceptor 12 is made from one of the above listed materials.

In one embodiment of the invention flange 102 may have an inner diameter 408 best indicated in FIG. 5, to allow a through bushing 302 or shaft 304 to pass through photoreceptor 12. A through bushing or shaft will often be used to mount photoreceptor 12 to the rest of the xerographic system.

Prior to assembly, outer diameter 106 is slightly larger than the inside diameter of photoreceptor 12. Flange 102 must be forced into the inside of photoreceptor 12 such that outer diameter 106 will come in firm contact with the inside surface of photoreceptor 12. This requires photoreceptor 12 to be manufactured such that it will expand slightly in the outward radial direction as flange 102 is inserted into its inside surface. This also requires flange 102 to be strong enough to withstand the inner radial compression load that will then be exerted upon it, once it has been press fit into the inside of photoreceptor 12.

The present invention includes forming flange 102 from a composite material which is a combination of polycarbonate, polytetrafluorethylene (PTFE) and glass. This combination of elements provides significant resistance against the torque that is applied to the photoreceptor/flange mating surface during printing operation and to the inner compression load that is applied to the flange during and after assembly. In one embodiment, flange 102 is made from 75% polycarbonate, 15% PTFE, and 10% glass, but other combinations of these elements may be used, and the invention is not limited to this embodiment. Those skilled in the art will also recognize that it is even possible to practice the invention by substituting similar or equivalent material for those listed (i.e. fiberglass), plastic, and numerous other materials may be used instead of glass.

It is, therefore, apparent that there has been provided in accordance with the present invention, an end flange for supporting an electrophotographic imaging member without using an adhesive that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An end flange capable of translating a rotational force from an outside source to a hollow cylindrical member comprising:

a) a circular member made from a composition which includes polycarbonate, polytetrafluorethylene, and glass; and b) an electrically conductive material attached to said circular member which provides a ground contact for said hollow cylindrical member.

2. An end flange as claimed in claim 1 wherein said electrically conductive material is a metal.

3. An end flange as claimed in claim 1 wherein said electrically conductive material is a metal selected from the group consisting of copper, silver, gold and platinum.

4. An end flange as claimed in claim 1 wherein said electrically conductive material is a metal alloy.

5. An end flange as claimed in claim 1 wherein said electrically conductive material is a metal alloy selected from the group consisting of brass, bronze, nickel-copper alloy, and stainless steel.

6. An end flange as claimed in claim 1 wherein said circular member composition provides resistance to compression applied in a radial direction.

7. An end flange as claimed in claim 1 wherein said circular member composition includes 75% polycarbonate and 15% polytetrafluorethylene.

8. An end flange as claimed in claim 1 wherein said circular member composition includes 75% polycarbonate, 15% polytetrafluorethylene, and 10% glass.

9. An electrophotographic imaging system comprising:

a) a source capable of generating a rotational force;

b) an end flange communicating with said source such that said rotational force is translated to said end flange, said end flange being made from a composite material which includes polycarbonate, polytetrafluorethylene, and glass;

d) a circular photoreceptor mounted to said end flange, thereby causing rotation of said end flange; and e) an electrically conductive substance mounted between said photoreceptor and said end flange to provide a grounding contact for said photoreceptor.

10. An electrophotographic imaging system as claimed in claim 9 wherein said electrically conductive substance is a metal.

11. An electrophotographic imaging system as claimed in claim 9 wherein said electrically conductive substance is a metal selected from the group consisting of copper, silver, gold and platinum.

12. An electrophotographic imaging system as claimed in claim 9 wherein said electrically conductive substance is a metal alloy.

13. An electrophotographic imaging system as claimed in claim 9 wherein said electrically conductive substance is a metal alloy selected from the group consisting of brass, bronze, nickel-copper alloy, and stainless steel.

14. An electrophotographic imaging system as claimed in claim 9 wherein said end flange composite material includes 75% polycarbonate and 15% polytetrafluorethylene.

15. An electrophotographic imaging system as claimed in claim 9 wherein said end flange composite material includes 75% polycarbonate, 15% polytetrafluorethylene, and 10% glass.

* * * * *